US005533799A

United States Patent [19]

Nickolaus, Jr.

[11] Patent Number: 5,533,799

[45] Date of Patent: Jul. 9, 1996

[54] SPRAY PAINTER'S CABINET

[76] Inventor: Edward L. Nickolaus, Jr., 2233 Country Club Dr., Laplace, La. 70068-1820

[21] Appl. No.: 384,025

[22] Filed: Feb. 6, 1995

[51] Int. Cl.[6] ..... A47B 46/00; A47B 49/00; A47B 97/00

[52] U.S. Cl. ..... 312/249.12; 312/209; 312/280; 312/249.1; 312/249.4; 312/249.5; 312/249.6; 312/249.8

[58] Field of Search ..... 312/249.12, 249.6, 312/313, 209, 248, 107.5, 109, 200, 204, 206, 249.8, 351.11, 351.13, 280, 296

[56] References Cited

U.S. PATENT DOCUMENTS

| | | | |
|---|---|---|---|
| 831,205 | 9/1906 | Barnard | 211/74 X |
| 843,826 | 2/1907 | Kloeppinger | 211/75 |
| 1,043,622 | 11/1912 | Miles | 211/74 |
| 1,353,974 | 9/1920 | Smith | 312/280 X |
| 1,927,837 | 9/1933 | Kingdon . | |
| 1,975,691 | 10/1934 | Hibbs | 312/206 X |
| 2,230,975 | 2/1941 | Gratz | 312/248 |
| 2,981,549 | 4/1961 | Hotton . | |
| 3,229,368 | 1/1966 | Tocchini | 312/280 X |
| 3,876,268 | 4/1975 | Colver | 312/209 |
| 3,955,683 | 5/1976 | Baren | 211/74 |
| 4,054,343 | 10/1977 | Keyland | 312/209 |
| 4,070,075 | 1/1978 | Morgan . | |
| 4,114,965 | 9/1978 | Oye et al. | 312/249.12 X |
| 4,155,609 | 5/1979 | Skaffe et al. | 312/245 |
| 4,436,353 | 3/1984 | Tucker | 312/241 |
| 4,478,467 | 10/1984 | Tyndall . | |
| 4,518,208 | 5/1985 | Marder . | |
| 4,652,062 | 3/1987 | Greenwood | 312/209 |
| 4,659,154 | 4/1987 | Jenkins . | |
| 4,759,560 | 7/1988 | Virgulti . | |
| 5,118,037 | 6/1992 | Ekegren | 312/200 X |
| 5,221,132 | 6/1993 | Combs et al. . | |
| 5,224,531 | 7/1993 | Blohm . | |
| 5,259,668 | 11/1993 | Teufel et al. | 312/249.12 X |
| 5,302,014 | 4/1994 | Hobson | 312/249.12 |
| 5,405,587 | 4/1995 | Fernandez et al. | 312/209 X |

*Primary Examiner*—Peter M. Cuomo
*Assistant Examiner*—Rodney B. White
*Attorney, Agent, or Firm*—David L. Ray

[57] ABSTRACT

A cabinet for storing spray painting equipment and supplies including a box-like body having two rectangular vertical parallel sidewalls rigidly connected to a vertical rectangular backwall, a rectangular horizontal bottom rigidly connected to the two rectangular vertical parallel sidewalls and the vertical rectangular backwall, a rectangular horizontal top rigidly connected to the two rectangular vertical parallel sidewalls and the vertical rectangular backwall, a door rotatably connected to one of the two rectangular sidewalls for enclosing the interior of the box-like body, at least one upper shelf rigidly connected to the interior of each of the two sidewalls and to the interior of the backwall, the shelf being aligned parallel to the rectangular horizontal top, a plurality of a slots for holding paint spray guns connected to the interior of the side walls between the shelf and the rectangular horizontal top for holding spray paint guns, a plurality of slidable pull-out drawers located adjacent to one of the two sidewalls, and at least one air-tight drawer connected to one of the sidewalls beneath the shelf for storing air sensitive respirators.

10 Claims, 3 Drawing Sheets

SPRAY PAINTER'S CABINET

BACKGROUND OF THE INVENTION

1. Field of the Invention

The invention relates to storage cabinets. More particularly, the present invention relates to storage cabinets for spray painting equipment and supplies.

2. Description of the Related Art

There are many storage cabinets and tool boxes known in the art. Exemplary of the processes of the prior art related to storage cabinets are the following U.S. Pat. Nos. 1,927,837; 2,981,549; 4,070,075; 4,478,467; 4,518,208; 4,659,154; 4,759,560; 5,221,132; and 5,224,531.

None of the cabinets of the prior art are directed specifically to the needs of an automobile painter. Commonly, an automobile painter leaves painting equipment such as spray-guns, power tools, air-tools, buffers, grinders, and the like unattended during the course of the day for lack of a storage cabinet in which the tool could be quickly and easily stored. Such unattended equipment is an easy target for theft. Furthermore, the unattended equipment can get dirty and get sprayed with paint.

Painters using spray-guns are generally required, and normally do use conventional respirators to prevent inhalation of paint and fumes which are hazardous to their health. Such respirators commonly employ charcoal filters, and such respirators should be placed in an air-tight compartment when not in use to extend the life of the charcoal filters.

Quite frequently painters and their helpers get small particles in their eyes. It is thus desirable that a mirror be located close to the area in which the painter is working to aid the painter in removing the particle.

Automobile painters also frequently spill paint, paint thinner, reducers, and other harmful substances on their clothing. Therefore, the painter needs an extra set of clothing located close to the area in which the painter is working after the clothing having the harmful substances thereon is removed.

Automobile painters commonly use wrenches, screwdrivers, sockets and socket wrenches, and the like which need to be stored quickly and easily after use. Furthermore, the automobile painter needs to keep written records of work to be done and work completed, and therefore commonly uses a clipboard which should be stored near the area in which the painter is working and protected from spray paint.

SUMMARY OF THE INVENTION

In accordance with the present invention there is provided a cabinet for storing spray painting equipment and supplies equipment including a box-like body having two rectangular vertical parallel sidewalls rigidly connected to a vertical rectangular backwall, a rectangular horizontal bottom rigidly connected to the two rectangular vertical parallel sidewalls and the vertical rectangular backwall, a rectangular horizontal top rigidly connected to the two rectangular vertical parallel sidewalls and the vertical rectangular backwall, a door rotatable connected to one of the two rectangular sidewalls for enclosing the interior of the box-like body, at least one upper shelf rigidly connected to the interior of each of the two sidewalls and to the interior of the backwall, the shelf being aligned parallel to the rectangular horizontal top, a plurality of a slot for holding paint spray guns connected to the interior of the side walls between the shelf and the rectangular horizontal top for holding spray paint guns, a plurality of slidable pull-out drawers located adjacent to one of the two sidewalls, and at least one air-tight drawer connected to one of the sidewalls beneath the shelf for storing air sensitive respirators.

The invention has the advantage of enabling spray painting equipment and supplies to be quickly and easily stored and locked to prevent damage to the equipment when not in use and to prevent theft of the equipment.

The invention has the further advantage of providing a foldable work table for the painter.

The invention has the additional advantage of providing an air-tight compartment for storing respirators to increase the life of the charcoal filters in the respirators.

DESCRIPTION OF THE PREFERRED EMBODIMENTS

Figure 1:
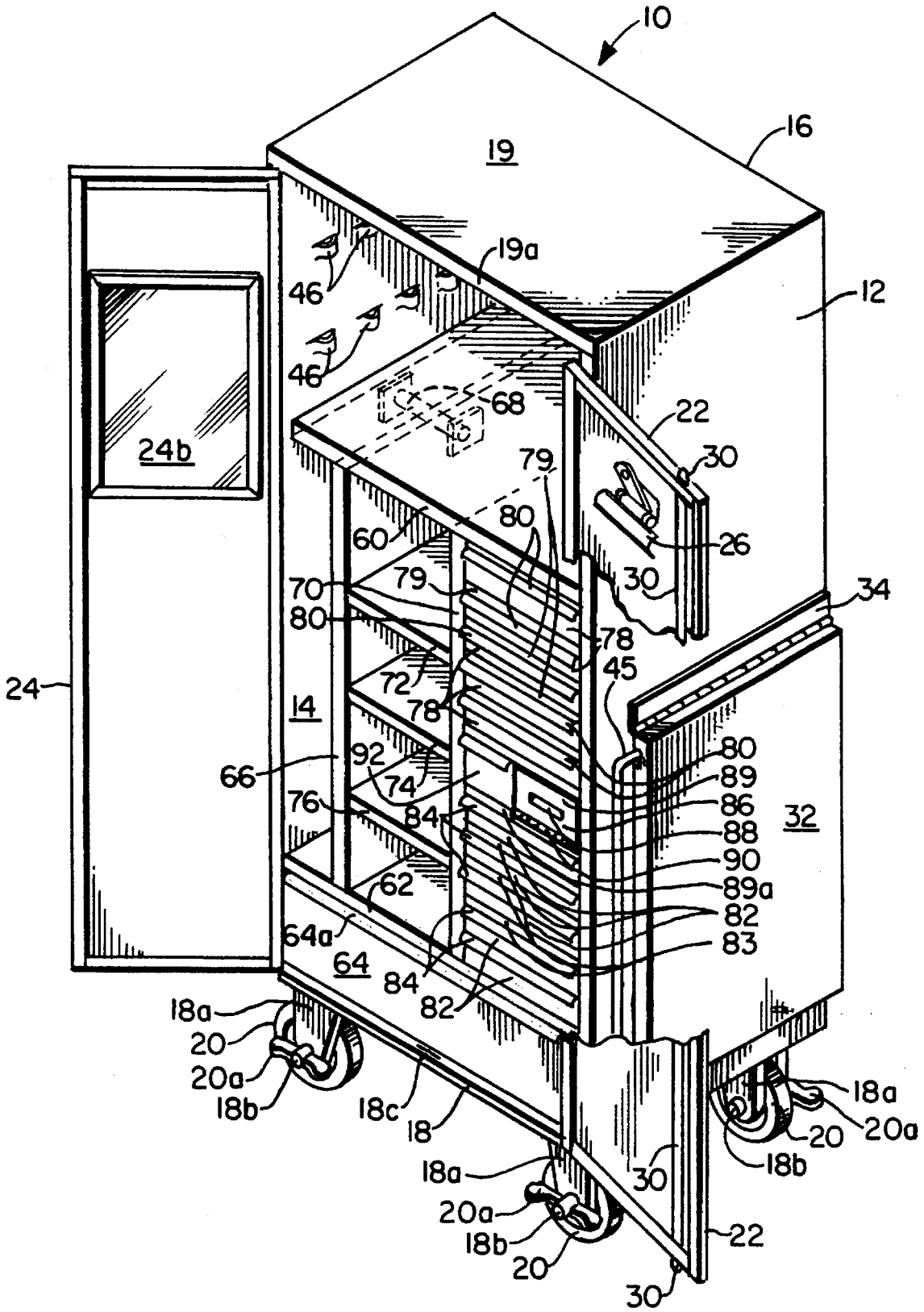
FIG. 1 is a perspective view, partly cut-away, of the spray painter's cabinet of the invention with the doors open.
Figure 2:
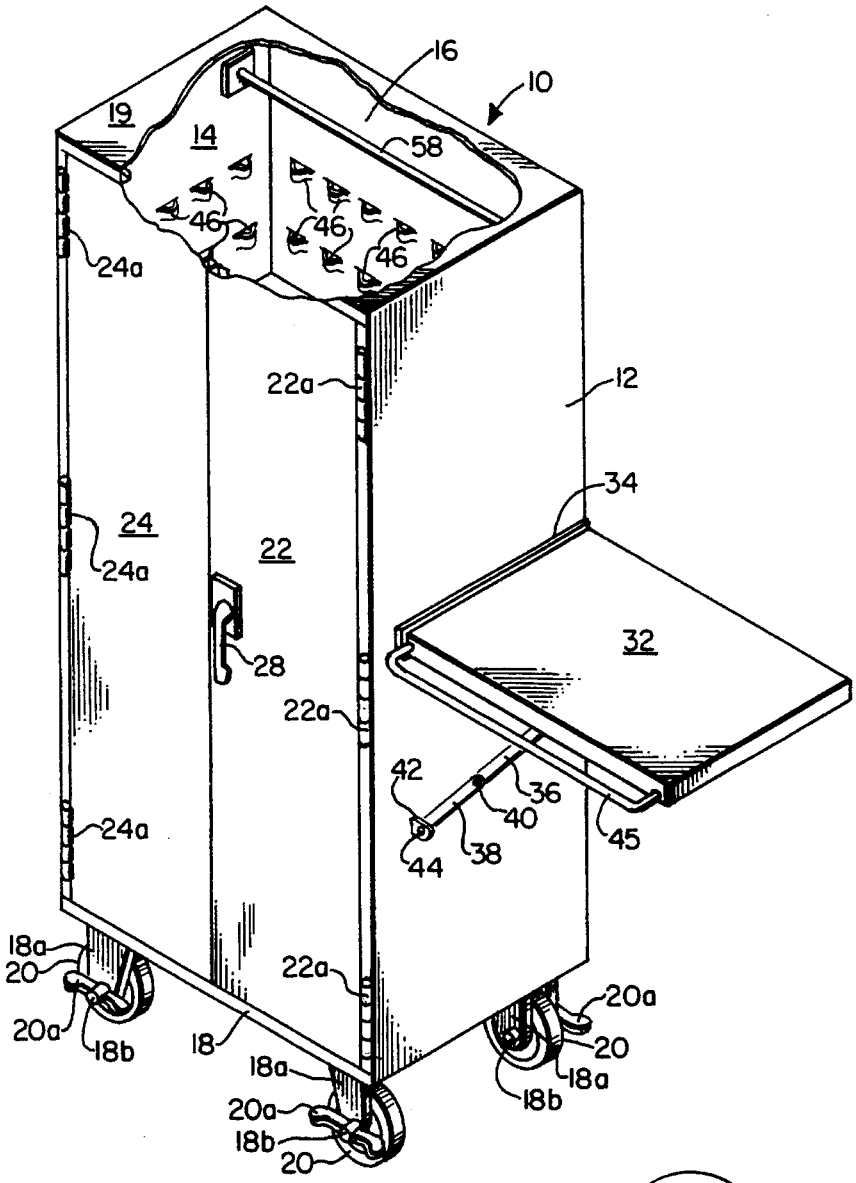
FIG. 2 is a perspective view, partly cut-away, of the spray painter's cabinet of the invention with the doors closed.

Referring now to the drawings, in FIGS. 1 and 2 are shown a first embodiment of the cabinet of the invention generally indicated by the numeral 10. Cabinet 10 has two parallel vertical rectangular sidewalls 12 and 14, a vertical rectangular backwall 16 connected perpendicularly to rectangular sidewalls 12 and 14, a rectangular horizontal bottom 18 connected perpendicularly to sidewalls 12 and 14 and backwall 16, and a rectangular horizontal top 19 connected perpendicularly to sidewalls 12 and 14 and backwall 16, rectangular horizontal being parallel to bottom 18. Rectangular sidewall 12 and 14 are identical in size, as are rectangular bottom 18 and rectangular top 19. Four wheels 20 are connected to the four corners of rectangular bottom 18 by brackets **18*a* and axles 18*b*. Preferably, wheels 20 have conventional locking devices 20*a*** thereon to selectively lock and release each wheel.

Two rectangular doors 22 and 24 are connected to sidewalls 12 and 14, respectively, by hinges **22*a* and 24*a*. Door 24 preferably has a mirror 24*b* connected on the inside thereof as shown in FIG. 1 for use by a painter, particularly when the painter gets particles in their eyes, which is a common occurrence for spray painters and technicians. Door 22 preferably has a conventional clipboard 26 connected thereto for hanging sheets of paper having estimates, repair orders, and the like, written thereon. Door 22 has a conventional rotatable handle 28 on the outside thereof for opening and locking door 22 by selectively sliding bar 30 upwards and downwards to engage the inside of lip 19*a* on rectangular top 19 and slot 18*c* on lip 18*b***.

Preferably, a rectangular foldable table 32 is rotatably connected to sidewall 12 by hinge 34. Hinge 34 is rigidly connected to sidewall 12 and table 32 to enable table 32 to rotate relative to sidewall 12. In FIG. 1 table 32 is shown folded against sidewall 12, and in FIG. 2 table 32 is shown locked perpendicularly to sidewall 12.

Table 32 is supported in the horizontal position by flat bar 36 which is rotatably connected to flat bar 38 by pin 40. Flat bar 38 is rotatably connected to bracket 42 by pin 44. Bracket 42 is rigidly connected to the outside of sidewall 12 by welding, bolting, screwing or the like. Pin 40 may be force fitted into flat bar 36 and flat bar 38 to hold flat bar 36 in alignment with flat bar 38 as shown in FIG. 2 to support table 32 in the horizontal position. Table 32 may be used as a work station to store and mix paint. Table 32 preferably has a rigid metal bar 45 connected thereto for hanging spray guns and the like thereon during the course of the work day.

Figure 3:
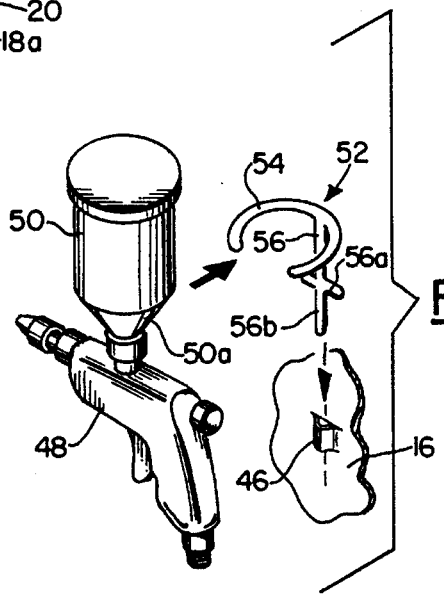
FIG. 3 is an exploded, perspective view of a conventional spray gun and a bracket for holding a spray gun, and a slot for receiving the bracket for holding a spray gun.

A plurality of slots 46 shown in FIGS. 1, 2 and 3 are connected to the inside of side wall 14 and backwall 16 for holding paint spray guns 48 having paint reservoirs 50 connected thereto. Paint reservoirs 50 have a tapered portion 50*a* which is connected to spray gun 48. A holding bracket generally indicated by the numeral 52 has a semi-circular shaped reservoir engaging member 54 rigidly connected to a vertical pin member 56 having a cross-bar 56*a* rigidly connected perpendicularly thereto and a lower portion 56*b* beneath cross-bar 56*a*. Lower portion 56*b* of pin 56 is slidably received in slot 46 as shown in FIG. 3, and the tapered portion 50*a* is slidably received in engaging member 54 to support and hold spray gun 48 inside cabinet 10.

A rigid metal rod 58 is rigidly connected to walls 12 and 14 as shown in FIG. 1. Rod 58 is used to hang automobile spray guns (not shown) having a hook on the top thereof which may be placed on rod 58 to support the automobile spray gun when not in use. Preferably rod 58 is coated with a soft material such as a plastic, polymeric coating known in the art to prevent the spray guns supported on rod 58 from being scratched by metal rod 58.

A rectangular top shelf 60 aligned parallel to bottom 18 and top 19 is rigidly connected to sidewalls 12 and 14 and to backwall 16 to separate the slots 46 and rod 58 from the remainder of the interior of cabinet 10 to define a space for hanging spray guns.

Located beneath top shelf 60 and aligned parallel thereto is bottom shelf 62 which is rigidly connected to sidewalls 12 and 14 and to backwall 16. A bottom drawer 64 is slidably received in cabinet 10 between bottom 18 and bottom shelf 62 and extends between sidewalls 12 and 14. Bottom drawer 64 has a lip 64a extending across the top thereof for grasping by hand to pull drawer 64 out from cabinet 10 to remove or place objects therein.

A vertical rectangular panel 66 is connected to shelves 60 and 62 parallel to sidewall 14 as shown in FIG. 1 to define a space between sidewall 14 and panel 66 for hanging clothing such as jackets and extra work clothes or uniforms in case of accidental paint spills on the painter's clothing. Such clothing may be hung on rod 68 shown in FIG. 1 which is connected to sidewall 14 and vertical panel 66.

A second vertical rectangular panel 70 is connected to shelves 60 and 62 parallel to sidewall 14 to define a space between panel 66 and second vertical panel 70 for receipt of a plurality of shelves 72, 74, and 76 aligned parallel to shelves 60 and 62 for storing finishing and preparation materials used in spray painting. Preferably, shelves 72, 74, and 76 are adjustable to enable the distance therebetween to be changed as necessary to store items of varying size.

Located between vertical panel 70 and sidewall 12 are a plurality of smaller pull-out drawers 78 each supported by shelves 79 and each having a lip 80 thereon for grasping by hand to pull drawers 78 out from cabinet 10 to remove or place objects therein such as screw drivers, wrenches, sockets, and the like. Located between vertical panel 70 and sidewall 12 are a plurality of larger pull-out drawers 82 supported by shelves 83 and each having a lip 84 thereon for grasping by hand to pull drawers 82 out from cabinet 10 to remove or place objects therein such as pneumatic tools, buffers, and the like.

Located between the lowest shelf 78 and the highest shelf 82 is an air-tight compartment 86 having a handle 88 connected to door 89 for opening compartment 86 for storage of respirators having charcoal air filters to prolong the effective life of the charcoal therein. Air-tight compartment 86 prohibits any air from entering the compartment when door 89 is closed. A hinge 90 rotatably connects door 89 to base 89*a* of compartment 86. Base 89 is rigidly connected to vertical panel 70 and sidewall 12. A pull-out drawer 92 may be located adjacent to air-tight compartment 86.

Figure 4:
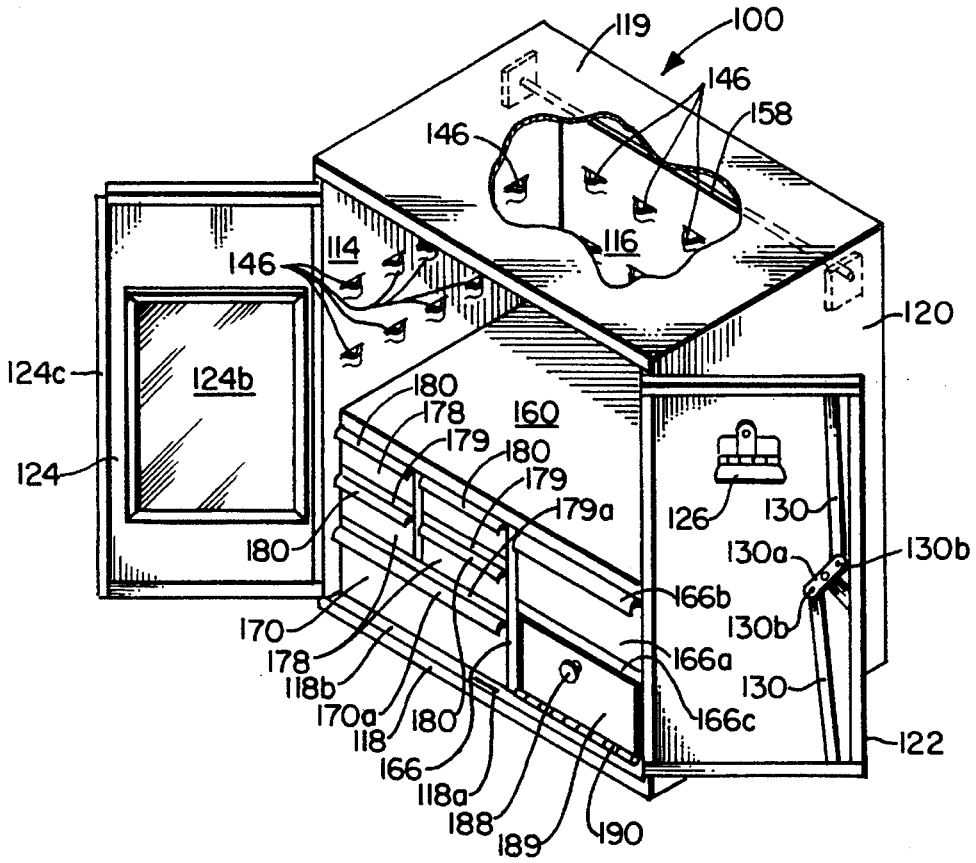
FIG. 4 is a perspective view, partly cut-away, of the spray painter's cabinet of an alternate embodiment of the invention with the doors open.
Figure 5:
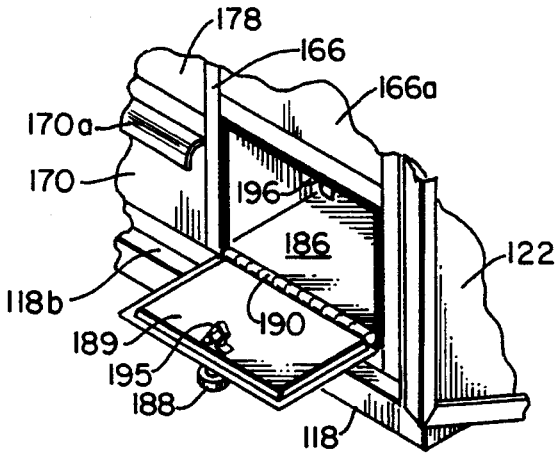
FIG. 5 is a partly cut-away, enlarged view of a drawer of the cabinet of the invention.

Referring now to FIGS. 4 and 5, an alternate embodiment of the cabinet of the invention is generally indicated by the numeral 100. As can be seen in FIGS. 4 and 5, cabinet 100 is a smaller version of cabinet 10 without some of the features of cabinet 10. Cabinet 110 may be placed on the floor of the working area or on a table or bench as desired.

Cabinet 100 has two parallel vertical rectangular sidewalls 120 and 114, a vertical rectangular backwall 116 connected perpendicularly to rectangular sidewalls 112 and 114, a rectangular horizontal bottom 118 connected perpendicularly to sidewalls 112 and 114 and backwall 116, and a rectangular horizontal top 119 connected perpendicularly to sidewalls 112 and 114 and backwall 116 which is parallel to bottom 118. Rectangular sidewall 112 and 114 are identical in size, as are rectangular bottom 118 and rectangular top 119.

Two rectangular doors 122 and 124 are connected to sidewalls 112 and 114, respectively, by hinges (not shown) similar to hinges 22*a* and 24*a* described above in the description of cabinet 10. Door 124 preferably has a mirror 124*b* connected on the inside thereof as shown in FIG. 4 for use by a painter, particularly when the painter gets particles in their eyes, which is a common occurrence for spray painters and technicians. Door 122 preferably has a conventional clipboard 126 connected thereto for hanging sheets of paper having estimates, repair orders, and the like, written thereon. Door 122 has a conventional rotatable handle 128 identical to handle 28 described above in the description of cabinet 10 on the outside thereof for opening and locking door 122 by selectively sliding bars 130—130 upwards and downwards to engage the inside of lip 119*a* on rectangular top 119 and slot 118*a* on the inside of lip 118*a* of bottom 118. Sliding bars 130—130 are connected to pivot bar 130*a* by pins 130*b*—130*b*. Pivot bar 130*a* has latch bar 130*c* rigidly connected thereto for selectively engaging the inside of lip 124*c* of door 124. Pivot bar 130*a* is rotated by a handle on the outside of door 122 identical to handle 28. Sliding bars 30—30 operate in an identical manner as sliding bars 130—130.

A plurality of slots 146 identical to slots 46 of cabinet 10 are shown in FIG. 4 connected to the inside of side wall 114 and backwall 116 for holding paint spray guns 48 shown in FIG. 3 having paint reservoirs 50 connected thereto. Paint reservoirs 50 have a tapered portion 50*a* which is connected to spray gun 48. A holding bracket generally indicated by the numeral 52 has a semi-circular shaped reservoir engaging member 54 rigidly connected to a vertical pin member 56 having a cross-bar 56*a* rigidly connected perpendicularly thereto and a lower portion 56*b* beneath cross-bar 56*a*. Lower portion 56*b* of pin 56 is slidably received in slot 46 as shown in FIG. 3, and the tapered portion 50*a* is slidably received in engaging member 54 to support and hold spray gun 48 inside cabinet 110.

A rigid metal rod 158 is rigidly connected to walls 112 and 114 as shown in FIG. 4. Rod 158 is used to hang automobile spray guns (not shown) having a hook on the top thereof which may be placed on rod 158 to support the automobile spray gun when not in use. Preferably rod 158 is coated with a soft material such as a plastic, polymeric coating known in the art to prevent the spray guns supported on rod 158 from being scratched by metal rod 158.

A rectangular top shelf 160 aligned parallel to bottom 118 and top 119 is rigidly connected to sidewalls 112 and 114 and to backwall 116 separates the slots 146 and rod 158 from the remainder of the interior of cabinet 110 to define a space for hanging spray guns.

A vertical rectangular panel 166 is connected to shelf 160 and bottom 118 parallel to sidewall 114 as shown in FIG. 4 to define two space between panel 166 and sidewalls 112 and 114 for receipt of a plurality of pull-out drawers 178 supported by shelves 179 and 179*a* each having a lip 180 thereon for grasping by hand to pull drawers 178 out from cabinet 110 to remove or place objects therein such as screw drivers, wrenches, sockets, and the like. Separating adjacent drawers 178 is vertical panel 178*a* which is connected to shelf 160 and bottom 118.

Located between vertical panel 166 and sidewall 120 is drawer 166*a* having lip 166*b* thereon for grasping and pulling drawer 166*a* out of cabinet 110. Drawer 166*a* is supported by shelf 166*c* connected to vertical panel 166 and sidewall 120.

Located between vertical panel 166 and sidewall 140 is drawer 170 having lip 170*a* thereon for grasping and pulling drawer 170 out of cabinet 110.

Located between the shelf 166*c* and bottom 118 is an airtight compartment 186 having a handle 188 connected to door 189 for opening compartment 186 for storage of respirators having charcoal air filters to prolong the effective life of the charcoal therein. A hinge 190 rotatably connects door 189 to lip 118*b*. Air-tight compartment 186 prevents any air from the outside of the compartment from entering the compartment. A tongue 195 is connected to the inside of door 189 and is received in keeper 196 to lock door 189. Air-tight compartment 86 is identical to air-tight compartment 186 except for the shape of the handles 88 and 188.

Although the preferred embodiments of the invention have been described in detail above, it should be understood that the invention is in no sense limited thereby, and its scope is to be determined by that of the following claims:

What is claimed is:

1. A cabinet for storing spray painting supplies and equipment comprising a box-like body having a. two rectangular vertical parallel sidewalls rigidly connected to a vertical rectangular backwall, b. a rectangular horizontal bottom rigidly connected to the bottom of said two rectangular vertical parallel sidewalls and said vertical rectangular backwall, c. a rectangular horizontal top rigidly connected to the top of said two rectangular vertical parallel sidewalls and said vertical rectangular backwall, d. door means rotatably connected to one of said two rectangular sidewalls for selective parallel alignment with said rectangular backwall to enclose a portion of the inside of said box-like body, e. at least one upper shelf rigidly connected to an inside surface of each of said two sidewalls and to an inside surface of said backwall, said shelf being aligned parallel to said rectangular horizontal top, f. a plurality of slot means for holding paint spray guns connected to inside surfaces said side walls between said shelf and said rectangular horizontal top for holding spray paint guns, g. a plurality of slidable pull-out drawers located between said two parallel sidewalls and adjacent to one of said two sidewalls, h. at least one air-tight drawer connected to the inside of one of said sidewalls beneath said shelf for storing air sensitive respirators, i. said cabinet having vertical space means therein for hanging clothes comprising a vertical rectangular panel located between and parallel to said vertical sidewalls connected perpendicularly to said upper shelf beneath said upper shelf adjacent to one of said sidewalls to define said vertical space between said vertical panel and said one of said sidewalls for hanging clothes, j. a horizontal rod connected to said vertical panel and said one of said sidewalls for receipt and hanging of clothes thereon, k. a flat, generally rectangular foldable table connected to an outside surface of one of said sidewalls, said foldable table being connected to said outside of one of said walls by hinge means, said foldable table having support means connected thereto for selectively supporting said table in a horizontal position perpendicular to said sidewall to which said table is rotatably connected, and l. a plurality of flat, rectangular shelves located beneath said upper shelf.

2. The cabinet of claim 1 herein a plurality of wheels are connected to said rectangular horizontal bottom.

3. The cabinet of claim 2 wherein said wheels have locking means connected thereto for selectively locking said wheels to prevent said wheels from rolling.

4. The cabinet of claim 1 wherein said door means has a mirror connected to an inside surface.

5. The cabinet of claim 4 wherein said door means has a clipboard connected to an inside surface.

6. The cabinet of claim 1 wherein said door means has a clipboard connected to an inside surface.

7. The cabinet of claim 1 wherein said door means comprises a first rectangular door rotatably connected to one of said two sidewalls and a second rectangular door connected to the other of said two sidewalls, one of said two doors having a mirror connected to an inside surface.

8. The cabinet of claim 1 wherein a horizontal rod is connected to each of said two sidewalls above said upper shelf for hanging spray paint guns thereon.

9. The cabinet of claim 1 wherein a plurality of slidable drawers are located therein beneath said upper shelf.

10. The cabinet of claim 1 where a lower slidable drawer is located between said sidewalls and adjacent to said bottom.

* * * * *